US005714291A

United States Patent [19]

Marinello et al.

[11] Patent Number: 5,714,291

[45] Date of Patent: Feb. 3, 1998

[54] SYSTEM FOR AUTHENTICATING PRINTED OR REPRODUCED DOCUMENTS

[75] Inventors: Daniel Marinello, 1895 Airport Exchange Blvd., Ste. 110, Erlanger, Ky. 41018; Louis Liang, 10601 Creston Dr., Los Altos, Calif. 94024; William G. McGinness, Burlington, Ky.

[73] Assignees: Daniel Marinello, Erlanger, Ky.; Louis Liang, Los Altos, Calif.; Angstrom Technologies, Erlanger, Ky.

[21] Appl. No.: 173,605

[22] Filed: Dec. 23, 1993

[51] Int. Cl.[6] ..... G03G 9/09

[52] U.S. Cl. ..... 430/106; 430/137

[58] Field of Search ..... 430/138, 106

[56] References Cited

U.S. PATENT DOCUMENTS

| | | | |
|---|---|---|---|
| 3,922,435 | 11/1975 | Asnes | 428/349 |
| 4,567,213 | 1/1986 | Bhatia et al. . | |
| 4,598,205 | 7/1986 | Kaule et al. | 250/458.1 |
| 4,739,377 | 4/1988 | Allen | 355/133 |
| 4,777,108 | 10/1988 | Adair | 430/138 |
| 4,997,864 | 3/1991 | Waters | 523/319 |
| 5,015,549 | 5/1991 | Grosso et al. | 430/138 |
| 5,110,717 | 5/1992 | Czekai et al. | 430/512 |
| 5,385,803 | 1/1995 | Duff et al. | 430/138 |

FOREIGN PATENT DOCUMENTS

| | | |
|---|---|---|
| 327199 | 8/1989 | European Pat. Off. . |
| 57-66441 | 4/1982 | Japan . |
| 64-29489 | 1/1989 | Japan . |
| 1201677 | 8/1989 | Japan . |
| 5-281786 | 10/1993 | Japan . |

OTHER PUBLICATIONS

Research Disclosure 30503 (Sep. 1989, pp. 631–632).

"Photochromic Papers or Filmes for Noncopyable Documents", by Japan Tokkyo Koho JP 8553981, Mar. 1989.

The Bar Code Book, Roger Palmer, Helmers Publishing, 1991, Peterborough, New Hampshire, FIG. 7.22, pp. 125–126.

Laser Printers: How Lights, Mirrors, and Static Electricity Work Together to Take Your Document form PC to Paper, by Cyndy Bates, pp. 372–373, Nov. 1992.

Laser Printers: Design and construction, InfoTrac –Magazine Index, Sep. 1993, 1–page Abstract.

*Primary Examiner*—John Goodrow

*Attorney, Agent, or Firm*—Majestic, Parsons, Siebert & Hsue

[57] ABSTRACT

An improved laser printer or photocopier toner for authentication is made by mixing conventional toner particles with submicron ultraviolet sensitive particles that exhibit detectable characteristics in response to ultraviolet radiation. A document printed using the improved toner can be authenticated using a UV scanner.

21 Claims, 2 Drawing Sheets

SYSTEM FOR AUTHENTICATING PRINTED OR REPRODUCED DOCUMENTS

BACKGROUND OF THE INVENTION

This application relates in general to systems for authenticating documents or to identify counterfeits, and more specifically, to a system for authenticating printed or reproduced documents and a material that can be used as a toner in printing or reproduction for authentication. The system of this invention enables counterfeit documents to be easily identified.

Many official documents such as visas, pass-ports, immigration documents, bank checks, and other security documents are printed with laser printers, and sometimes reproduced using photocopiers. The quality of laser printing and photocopying has improved dramatically in recent years. Since the font types and lettering sizes can be customized, many types of documents are made using laser printers and photocopiers.

Different types of high quality laser printers, photocopiers, optical scanners, and high speed graphic processing computers are now widely available at low cost. Using such equipment, counterfeiters can easily duplicate or alter documents by matching official documents. Hence, counterfeiters are able to produce duplicates of the original official documents or altered official documents that are very difficult to distinguish from authentic ones.

The above-described problem is particularly acute where authentication of an official document such as visas, passports, other immigration documents, bank checks, or other security documents must be authenticated quickly and on site, such as at ports of entry or at bank windows. It is therefore desirable to provide a system that can be used quickly and conveniently to authenticate laser printed or photocopied documents.

SUMMARY OF THE INVENTION

This invention is based on the observation that, by mixing the conventional laser printer toner or photocopier toner with particles that exhibit detectable characteristics in response to ultraviolet light, printed or photocopied official documents can be authenticated easily when such improved toner mixture is used in printing or photocopying.

Therefore, one aspect of the invention is directed towards a material for authentication comprising a mixture of laser printer or photocopier toner particles and ultraviolet (UV) sensitive particles that are detectable in response to ultraviolet light.

Another aspect of the invention is directed towards a method to prepare a laser printer or photocopier toner material for authentication comprising providing UV sensitive particles and mixing laser printer or photocopier toner particles and said UV sensitive particles to provide the laser printer or photocopier toner material for authentication.

Another aspect of the invention is directed towards a method for making a document that can be authenticated comprising providing a toner material that emits light in response to ultraviolet radiation and printing a document using said material and a laser printer or a photocopier.

Yet another aspect of the invention is directed towards a method for authenticating a document. The method comprises providing a toner material that emits light in response to ultraviolet radiation, printing a document using said material and a laser printer or a photocopier, providing ultraviolet radiation to the document and detecting the response of the document to the radiation.

BRIEF DESCRIPTION OF THE DRAWINGS

For simplicity in description, identical components in different figures of this application are identified by the same numerals.

DETAILED DESCRIPTION OF THE PREFERRED EMBODIMENT

Figure 1:
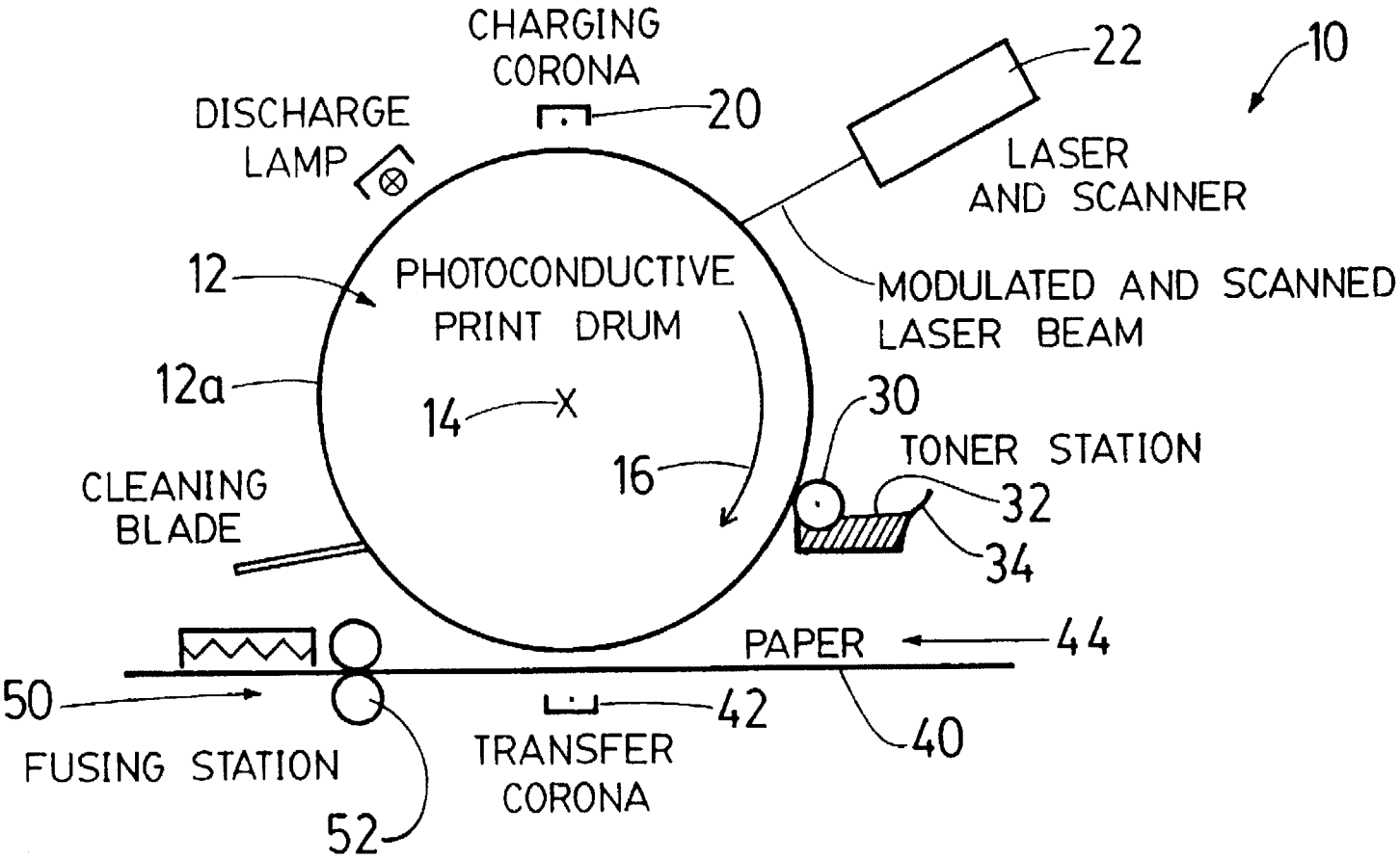
FIG. 1. (PRIOR ART)
FIG. 1 is a schematic view of a conventional laser printer (xerographic process) useful for illustrating the invention.

FIG. 1 is a schematic diagram of a conventional laser printer (xerographic process) useful for illustrating the invention and is taken from FIG. 7.22 on page 126 of *The Bar Code Book*, Roger Palmer, Helmers Publishing, 1991, Peterborough, N.H. 03458. As shown in FIG. 1, laser printer 10 includes a photoconductive print drum 12 having a drum surface 12*a*. Surface 12*a* is typically a photosensitive semiconducting surface which can hold electrical charges deposited on it. The surface is photoconductive so that, when any portion of the surface is exposed to light, electrical charges deposited on such portion will be discharged through the drum.

The drum 12 has axis 14. As the drum is rotated about axis 14 along arrow 16, charging corona 20 deposits electrical charges onto and charges a portion of the drum surface 12*a*. Where a laser printer 10 is used to print a document on 8 ½"×11" paper, the portion of the drum may be such as to fit within such a page. After electrical charges are deposited by charging corona 20 onto such portion of surface 12*a*, rotational motion of the drum along arrow 16, and the position of a laser beam controlled and modulated by a computer system (not shown) causes selected areas of the portion of drum surface 12*a* to be exposed to light from a laser and scanner 22. Typically, the laser beam from laser and scanner 22 would be commanded to trace alphanumeric characters or graphic images by the computer system. The electrical charges on the selected areas of the portion on surface 12*a* exposed to the laser beam from laser and scanner 22 would dissipate and become uncharged, whereas the remainder of the portion will remain charged.

As also shown in FIG. 1, surface 12*a* of the drum is in contact with a toner pickup roller 30, whose surface is in contact with laser printer toner particles 32 inside a toner cartridge 34. The toner pickup roller 30 is electrostatically charged by passing current through it, so that as roller 30 is rotated, the toner particles 32 would stick to the surface of roller 30 and be uniformly distributed over its surface. The toner particles on surface of roller 30 are charged with the electrostatic charges of the same polarity as that deposited by charging corona 20 onto the portion of surface 12*a*, now in contact with roller 30. Therefore, when the portion of surface 12*a* charged by corona 20 (erased in selected areas by laser and scanner 22) comes into contact with roller 30, the toner particles will be attracted to and be deposited only on the selected areas exposed to the laser beam from the laser and scanner 22 and not on the remainder of the portion, since the remainder of the portion is charged to the same polarity electrostatically as the toner particles on pickup roller 30. Therefore, the portion of surface 12*a* would be populated with the toner particles only on the selected areas that are traced by the laser beam from laser and scanner 22 and not on other areas of the portion.

Upon further rotation, the portion of surface 12*a* carrying the toner particles comes into contact with paper 40. A transfer corona 42 is charged to such potential and of different polarity from that of toner particles on drum 12 so that it deposits a small amount of electrical charge of the opposite polarity to that of the toner on paper 40 and causes the toner particles to leave surface 12*a* of the drum and stick to the paper 40. Paper 40 is transported in the direction along arrow 44 at an appropriate speed so that toner particles on drum surface 12*a* will become deposited on paper 40 in substantially the same shape as they were on drum surface 12*a*. At this point, the only force holding the toner particles to paper 40 is electrostatic attraction.

The paper and toner particles carried thereon are then passed through a fusing station 50, thereby causing the toner particles to securely attach to paper 40. Typically, the fusing station 50 would employ rollers 52 to heat the toner particles and paper as well as apply pressure to press the toner particles against the paper. In some embodiments, a separate heating element (not shown) is placed between the transfer corona and the fusing station to heat the toner particles before they reach the fusing station 50. The above is a description of a conventional laser printer operation.

Conventional photocopying operation is analogous to that described above in reference to FIG. 1. The only difference between a photocopying operation and the laser printing operation described above is that in the laser printing operation, the image on the print drum 12 is formed by tracing a laser beam on the surface of the drum, whereas, in a photocopying operation, on the other hand, this is performed by exposing areas of the drum that would correspond to an original to be copied. Both operations are well-known to those skilled in the printing and photocopying art.

Toner particles used for laser printing or photocopying typically include the following major components:

(1) Pigments such as carbon black and other color or colorless dyes.

(2) Magnetite particles used to evenly distribute the toner particles on a pickup transfer roller, such as roller 30.

(3) Filler material which provides lubrication properties to the toner and melt upon heating and fusing to bond the toner particles to the printed media (paper or transparent foils).

As known to those skilled in the art, magnetite particles are essentially magnetic fingers that would cause charged toner particles to stick onto the fingers and cause the toner particles to be evenly distributed on the pickup transfer roller such as roller 30. The filler materials are typically Acrylic copolymers that are highly cross linked and have relatively low melting point (below 100 degrees C). Examples are polypropylene, polyethylene, etc., in microcrystalline form (micro-ground to submicron sizes). The filler material provides lubrication properties so as to reduce agglomeration of the toner particles. The filler material has the further function in that it would melt upon fusing so as to bond the toner particles to the printed media such as paper or transparencies. All of the above-described components of the toner are electrostatically chargeable.

As is also known to those skilled in the art, the pigment and magnetite particles are compatible to the filler materials. As used in this application, when one substance is "compatible" to another substance, it means that the two substances have similar physical chemistry (density, weight, size, etc.) so that the two substances would not separate by settlement or other processes.

In the laser printing or photocopying processes referenced above, all components of the toner particles can be electrostatically charged so that they will stick to the selected areas scanned by the laser light beam in the laser printing process or otherwise exposed in the photocopying process. Upon fusing, the filler material will melt so as to bond the pigment particles to the printed medium at the fusing station 50.

This invention is based on the observation that, by mixing laser printer or photocopier toner particles with UV sensitive particles that have detectable characteristics when exposed to ultraviolet light, and using the mixture in laser printing or photocopying process as described above in reference to FIG. 1, the resulting document can be authenticated conveniently and quickly. For at least some of the UV sensitive particles, each UV sensitive particle preferably comprises an encapsulant. The encapsulant may be a polymer or a copolymer, a polyolefin, or other hydrocarbon polymer or styrene. An appropriate encapsulant may be polypropylene or polyethylene. Preferably, the encapsulant is compatible with the filler material in the toner. It is also desirable for the encapsulant to have glass transition temperature below 87 degrees C and melting point below 230 degrees C.

The UV sensitive particles may be formed by first providing UV sensitive compounds of submicron size. Suitable UV sensitive compounds include yttrium oxides ($Y_2O_3$) and other rare earth metal lumiphores, Dayglo fluorescent chemicals available from Lawter Chemicals, Inc. of Northbrook, Ill., fluorescent brighteners from Ceiba Geigy of Hawthorn, N.Y., oxazoles, thiazoles, cumene, stilbenes, and their derivatives. An example of oxazoles that can be used for this purpose are compounds 4 and 6 from Angstrom Technologies, Inc. of Erlanger, Ky. 41018. The use of compounds 4 and 6 from Angstrom Technologies, Inc. may be preferable because they are less toxic compared to the rare earth compounds, some of which are listed above. Compounds 4 and 6 in dimensions larger than 1 micron are available commercially from Angstrom Technologies, Inc. In order to provide compound 4 or compound 6 in submicron sizes, the larger size compound 4 and compound 6 may be broken up in a process such as through successive milling that is known to those skilled in the art.

Preferably, the UV sensitive ingredient in the UV sensitive particles is stable at temperatures up to 50 degrees Celcius or even up to 100 degrees Celcius if possible, have molecular weight greater than 200 (preferably greater than 250). The UV sensitive ingredient such as Angstrom compounds 4 or 6 or any of the other compounds listed above may then be encapsulated in a process known in the chemical processing industry. Briefly, such ingredients are suspended in an encapsulation solution and precipitated in a cool ambient (such as below 50 degrees C). The encapsulant solidifes and encapsulates submicron UV compounds forming UV sensitive particles in submicron sizes. The particles can be sieved as known to those skilled in the art to ensure submicron sizes of the overall UV sensitive particles that are mixed with the toner particles. Larger particles left after the sieving process may be milled/ground again into submicron sizes. Preferably, the UV sensitive particles are less than 0.5 microns in dimensions.

Preferably, the UV sensitive particles are insoluble in water or organic solvents to reduce "feathering" effect during the fusing process at the fusing station 50 in FIG. 1. The compounds referenced above, including compounds 4 and 6, from Angstrom Technologies, Inc., have such characteristics. Since the UV sensitive particles will undergo the heating and fusing operations, it is preferable for the UV sensitive particles to have stable fluorescent characteristics at temperatures below about 50 degrees Celcius. In the event that the laser printing or photocopying process employs higher temperatures than 50 degrees Celcius in the heating and fusing operations, it may be desirable for the UV sensitive particles to have stable fluorescent characteristics at temperatures up to 100 degrees Celcius.

The encapsulant ingredient of the UV sensitive particles can properly be electrostatically charged in a manner similar to the toner fillers and fused with the printed medium during the heating and fusing process so that the UV sensitive chemical will also be permanently attached to the printed medium.

It is preferable for the UV sensitive particle to have small submicron sizes (e.g. 0.5 micron) since toner particles are also submicron in size. If the UV sensitive particles are larger in size compared to the toner particles, it may be difficult for the UV sensitive particles to be evenly distributed throughout the toner particles and not be separated from the toner particles. Furthermore, smaller particle size would enable the same amount of fluorescent material to cover a larger area so that even a small amount of UV sensitive material will be spread throughout the printed or photocopied area and more readily detectable. In order for the UV sensitive particles to mix uniformly with the toner particles, it is preferable for the UV sensitive particles to have substantially the same bulk density as the toner particles.

Whether documents printed using the above-described mixture of conventional toner particles and UV sensitive particles can be detected visually by the naked eye can be controlled by altering the loading factor. Typically, where the loading of said UV sensitive particles is only about 2–5% that of the toner particles by weight in the mixture, documents printed using the mixture would typically not be noticeable with the naked eye. Instead, a special UV black light or UV scanner would be necessary for authentication. Where it is desirable to provide the capability of a quick authentication by mere observation by the naked eye, the proportion of the UV sensitive particles may be increased to at least about 8% that of the toner particles by weight so that images printed using the mixture are visually identifiable without the aid of instruments. Where it is desirable to print or photocopy in colors other than black, color pigment particles may be used instead of color black in the toner. Where it is desirable for the print to be invisible, colorless pigment may be used instead. An alternative to providing visually identifiable printed images by increasing the loading factor is to add visible pigment particles to the mixture of UV sensitive particles and conventional toner particles.

Figure 2:
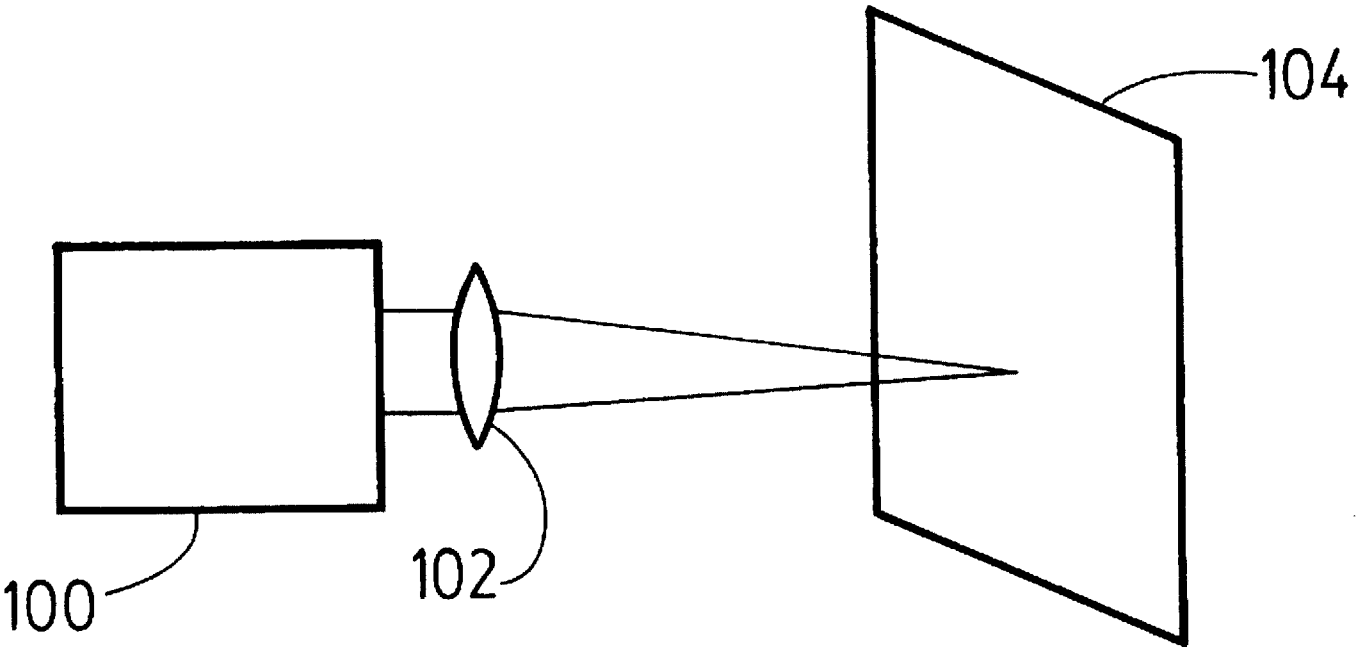
FIG. 2 is a schematic view of a UV scanner and a document to illustrate the concept of the invention.

A method for making a document that can be authenticated is now described. First, a toner material that fluoresces in response to UV radiation is provided (such as in the manner described above) and a document is printed or photocopied using said material and the laser printer or a photocopier, in a process such as described above in reference to FIG. 1. The authentication may then be carried out in a process shown in FIG. 2. As shown in FIG. 2, a UV scanner 100 provides UV radiation through a lens 102 to a document 104 which has been printed or photocopied using the toner material that emits light in response to UV radiation. Scanner 100 is then used to detect the response of document 104 to the UV radiation in order to authenticate the document. The response of the document may be to emit visible light, or UV or infrared radiation from the document, so that detection of such light or radiation authenticates the document.

In addition to detection of broadband fluorescence, it is possible to further enhance authentication capability by using UV sensitive particles that emit radiation of specific frequencies rather than broadband radiation. By using Angstrom's compound 4 or 6 each emitting radiation of a specific frequency in response to UV radiation to print or photocopy authentic documents, a counterfeit that emits broadband radiation in response to UV radiation can be readily detected as such by using a UV scanner to detect the specific frequency of the compound used. Obviously, specific frequency UV sensitive compounds other than Angstrom's compound 4 or 6 such as some of the compounds referenced above may be used for this purpose and are within the scope of the invention. The presence of UV sensitive particles emitting radiation of specific frequencies may be detected by detecting the entire spectrum of fluorescence or the intensity of such fluorescence at specific frequencies from a sample using a spectrometer.

While the invention has been described above by reference to various embodiments above, it will be understood that various modifications and changes may be made without departing from the scope of the invention which is to be limited only by the appended claims.

What is claimed is:

1. A material for authentication comprising a mixture of laser printer or photocopier toner particles and UV sensitive particles that exhibit detectable characteristics in response to UV irradiation, wherein the UV sensitive particles have dimensions less than 1 micron in size.

2. The material of claim 1, wherein each UV sensitive particle comprises a UV sensitive portion, a magnetite portion, and an encapsulant.

3. The material of claim 1, wherein each UV sensitive particle comprises an encapsulant.

4. The material of claim 3, wherein the encapsulant is a polymer or copolymer.

5. The material of claim 4, wherein said encapsulant is a polyolefin or other hydrocarbon polymer or styrene.

6. The material of claim 5, wherein said encapsulant is polypropylene or polyethylene.

7. The material of claim 3, wherein said toner particles includes filler material, and wherein said encapsulant is compatible with said filler material.

8. The material of claim 3, wherein said encapsulant has a glass transition temperature below 87 degrees C and a melting point below 230 degrees C.

9. The material of claim 1, wherein the UV sensitive particles are insoluble in solvents.

10. A material for authentication comprising a mixture of laser printer or photocopier toner particles and UV sensitive particles that exhibit detectable characteristics in response to UV irradiation, wherein the UV sensitive particles have stable fluorescent characteristics at a temperature above 50 degrees Centigrade.

11. The material of claim 1, wherein the UV sensitive particles have stable fluorescent characteristics when illuminated by light.

12. The material of claim 1, wherein said UV sensitive particles have the same bulk density as the toner particles.

13. A material for authentication comprising a mixture of black laser printer or photocopier toner particles, UV sensitive particles that exhibit detectable characteristics in response to UV irradiation and visible color pigments to provide visually identifiable printed images.

14. A method to prepare a laser printer or photocopier toner material for authentication comprising:

providing submicron UV sensitive particles that exhibit detectable characteristics in response to UV irradiation; and mixing laser printer or photocopier toner particles and said UV sensitive particles.

15. The method of claim 14, said method further including breaking the UV sensitive particles having dimensions larger than 1 micron into submicron particles.

16. The method of claim 15, wherein said breaking step is performed by milling the UV sensitive particles having dimensions larger than 1 micron into submicron particles.

17. The method of claim 15, said method further including the step of encapsulating the UV sensitive particles by a bonding substance after the breaking step is performed.

18. The method of claim 17, further comprising filtering the encapsulated UV sensitive particles.

19. A material for authentication comprising a mixture of laser printer or photocopier toner particles and submicron-size UV sensitive particles that exhibit detectable characteristics in response to UV irradiation, said UV sensitive particles being one or more of the following substances: oxazoles, thiazoles, cumene or stilbenes or one or more of their derivatives.

20. The material of claim 1, wherein said UV sensitive particles have dimensions less than 0.5 micron in size.

21. The material of claim 13, wherein the UV sensitive particles have stable fluorescent characteristics when illuminated by light.

* * * * *